United States Patent [19]

Bowen

[11] Patent Number: 4,673,182

[45] Date of Patent: Jun. 16, 1987

[54] PIVOTED TRACK AND SLOT CAR AMUSEMENT DEVICE OR GAME

[76] Inventor: Robert L. Bowen, 925 Malley Dr., Northglenn, Colo. 80233

[21] Appl. No.: 843,869

[22] Filed: Mar. 25, 1986

Related U.S. Application Data

[63] Continuation of Ser. No. 656,542, Oct. 1, 1984, abandoned.

[51] Int. Cl.[4] ..... A63B 67/14; A63B 71/00; A63G 1/00; A63F 9/14

[52] U.S. Cl. ..... 273/110; 273/86 C; 273/128 R; 446/445; 446/465; 104/53

[58] Field of Search ..... 273/86 C, 110, 128 A, 273/86 B; 446/431, 444, 445, 446, 465

[56] References Cited

U.S. PATENT DOCUMENTS

| | | | |
|---|---|---|---|
| 586,437 | 7/1897 | Howe | 273/110 |
| 1,572,069 | 2/1926 | Kline | 273/86 C |
| 1,701,503 | 2/1929 | Marx | 272/35 |
| 1,729,049 | 9/1929 | Olsen | 273/86 C |
| 2,767,986 | 10/1956 | Newberry | 273/86 C |
| 3,241,263 | 3/1966 | Branstner | 104/140 |
| 3,540,380 | 11/1970 | Tumpak | 104/140 |
| 3,844,562 | 10/1974 | Foley et al. | 273/110 |
| 3,879,039 | 4/1975 | Holden | 273/110 |
| 4,094,507 | 6/1978 | Kauffmann | 273/110 |
| 4,227,693 | 10/1980 | Moe et al. | 273/86 C |

FOREIGN PATENT DOCUMENTS

| | | | |
|---|---|---|---|
| 918740 | 11/1946 | France | 273/86 C |
| 1312061 | 11/1962 | France | 273/110 |

*Primary Examiner*—Richard C. Pinkham
*Assistant Examiner*—Benjamin Layno
*Attorney, Agent, or Firm*—Horace B. Van Valkenburgh

[57] ABSTRACT

A track having spaced, parallel edges, including a plurality of adjacent curves facing in different directions and connections between the curves, around which a frame carrying an object, such as simulating a racing car, a greyhound, a horse, a camel or the like, is moved by gravity when the track is tipped. An inner panel has an outer contour providing the inner edge of the track, while an outer panel has an inner contour providing the outer edge of the track. The frame on which the object is mounted carries a pair of wheels engaging both the bottom and the top of the track at each side. The frame also carries a pair of circular, rotatable ball bearings mounted for rotation in the plane of the track panels and engageable alternatively with the opposed edges of the track for guiding the object around the track. The spacing between the track edges is slightly greater than the diameter of the ball bearings, to provide clearance. A lower panel supports the track panels and, in turn, has a centrally depending, circular block which is engageable with a flat top surface of a support pedestal. The support pedestal and circular block each have a central socket with a coil spring extending between the sockets to resiliently support the track but permit pivoting of the track to different successive tipped positions on the pedestal, to cause the object to move around the track by gravity.

17 Claims, 14 Drawing Figures

PIVOTED TRACK AND SLOT CAR AMUSEMENT DEVICE OR GAME

This application is a continuation of application Ser. No. 656,542, filed Oct. 1, 1984 and abandoned.

This invention relates to amusement devices which can also be used as games and, more particularly, to a pivoted slot track and car amusement device or game.

BACKGROUND OF THE INVENTION

Various amusement devices, some of which can be used as games, have included various types of plates, boards or the like on which one or more objects may be placed to follow a path on or around the board, or to otherwise be moved by gravity, when the board is tipped in a certain direction. Thus, U.S. Pat. No. 3,844,562 discloses a coil spring for supporting a plate having a series of circular walls, with openings at opposed positions in alternate walls. Balls, such as marbles, are placed in pockets around the outer rim of the circular plate to tip the plate to a desired position, so that a playing ball, which is placed in the inner space, will move through an opening into the next outer space. U.S. Pat. No. 2,767,986 discloses a racing game involving two toy cars and an elliptical track having a corresponding inner edge, while each car has an arm whose end extends over and around the outer and inner edge of the track, respectively. The track may be supported by pins at opposite ends, or a central pivot pin, permitting tipping to different positions. Each arm is connected to the axle for the front wheels, so as to cause the wheels to turn as the respective arm moves around the curved end of the respective edge of the track. U.S. Pat. No. 1,572,069 discloses a toy for rolling marbles down a plate, which is mounted on a number of springs around its edges and is vibrated by an eccentric turned by a hand crank. Holes at one end of the plate receive ovoid racers which are caused to move from one end of the plate to the other through the vibrations produced by the eccentric. U.S. Pat. No. 1,701,503 discloses a plate having annular tracks, one inside the other, flanked by upstanding ridges, with a toy racing car placed on each track. The racers are moved around by tilting the track through an oscillating motion imparted by a hand operated device under the track. U.S. Pat. No. 1,729,049 discloses a platform provided with a pair of oval slots through which an arm extends from a corresponding racing car. Each car is moved by a pivoted roller mounted on the end of a flexible cord connected with the respective arm with each roller placed in one of a pair of oval troughs disposed beneath the tracks. One trough is pivoted by a crank handle at one side of the platform, and the other trough by a crank handle at the other side. By pivoting the troughs, the players cause the racing cars to move around the respective tracks, due to the pull of the corresponding roller, induced by gravity. Other U.S. patents showing tilting tracks or troughs, including separately pivotal sections, include U.S. Pat. Nos. 2,655,016; 3,879,039; 4,094,507 and 4,227,693.

As will be evident, each of the marble or marble-type games do not produce the speed which a toy racing car or the like can be made to attain, through proper manipulation of a track having an adequate configuration, while racing cars having an arm extending over an edge of a track or connected to a roller in a trough do not appear to be able to follow a configuration more complicated than an oval.

Among the objects of this invention are to provide a device by which a racing car or the like can be made to attain speeds considerably in excess of prior devices and which may be utilized as an amusement device or as a game; to provide such a device in which acceleration of the car or the like is produced by gravity; to provide such a device which includes a track whose configuration is conducive to consecutive accelerations of a racing car or the like in traveling around the track, when the track is tipped in different directions; to provide such a device which will increase the speed of the car or the like at each tipping; to provide such a device in which a slot forms a track and the car or the like is adequately guided around the track; to provide such a device in which the track may be formed between a pair of planar panels from the configuration of the inner edge of one and the outer edge of the other, with the edges being parallel but spaced apart to form a track slot; to provide such a device in which the car or the like is adequately maintained in position on the track and is adapted to move around the track on rollers, wheels or the like; to provide such a device in which the board or track assembly is resiliently supported from a central position, permitting the track to be tipped in any direction; to provide such a device in which a car or the like is adequately guided around a track having consecutive curvatures in different directions on each side; and to provide such a device which is relatively simple in construction and effective in use.

SUMMARY OF THE INVENTION

The pivoted slot and car amusement device or game constructed in accordance with this invention includes a model racing car or the like mounted on a frame having a pair of upper wheels and lower wheels on each side for engaging the top and bottom, respectively, of an inner panel and outer panel with the inner edge of the outer panel and the spaced outer edge of the inner panel providing the contour of the track. Along the center line of the frame, as at the front and rear, preferably between the front and rear sets of wheels, a pair of ball bearings or similarly readily rotatable elements are mounted, as on bolts or the like which connect the upper and lower portions of the frame. The ball bearings are positioned directly in the track and the outer diameter of the ball bearings, which guide the car frame around the track, is slightly less than the width of the track. The width of the track and the diameter of the ball bearings are correlated with the radius of the minimum radius of arc of the track, so that the frame carrying the car will move around any curve without binding of the guide bearings.

The configuration of the track should include a series of arcs which alternate in being outer curves, i.e. with a center radius on the side of the curve toward the center of the track assembly, and inner curves, i.e. with the center of the radius on the opposite side of the curve from the center of the track assembly. The preferred form of the track assembly is square but with rounded corners, and an outer curve at each outer corner and an inner curve spaced inwardly from the center or each side of the square, with connecting portions of the track between consecutive outer and inner curves and vice-versa, being approximately a straight line. Other arrangements of the curves can, of course, be utilized. It is primarily along the straight lines that the maximum acceleration of the car may be obtained since the track may be tipped in the same direction as the relatively straight connecting portion, so that as the car moves from one curve to the next, it will have a longer time to accelerate before the track position must be changed. The track assembly is supported by a pedestal or base beneath, with a heavy coil spring being placed in an upright socket of the supporting pedestal and extending into a socket in a cylindrical block at the center of the track assembly and extends downwardly therefrom. With the track assembly level and its weight on the spring, as in FIG. 2, there is a small space between the block and the pedestal, but when the track is tipped in any direction, the circular lower edge of the block will engage the top of the pedestal and the track may be tilted further in a desired direction. When the direction of tilt is to be changed, the lower edge of the block will roll around the top of the pedestal, thus facilitating a change in the direction of tilt. In addition, a lower panel rigidifies the construction, being connected by ribs and side bars to both the inner and outer, upper panels, to provide a track assembly.

THE DRAWINGS

DESCRIPTION OF THE PREFERRED EMBODIMENT

Figure 1:
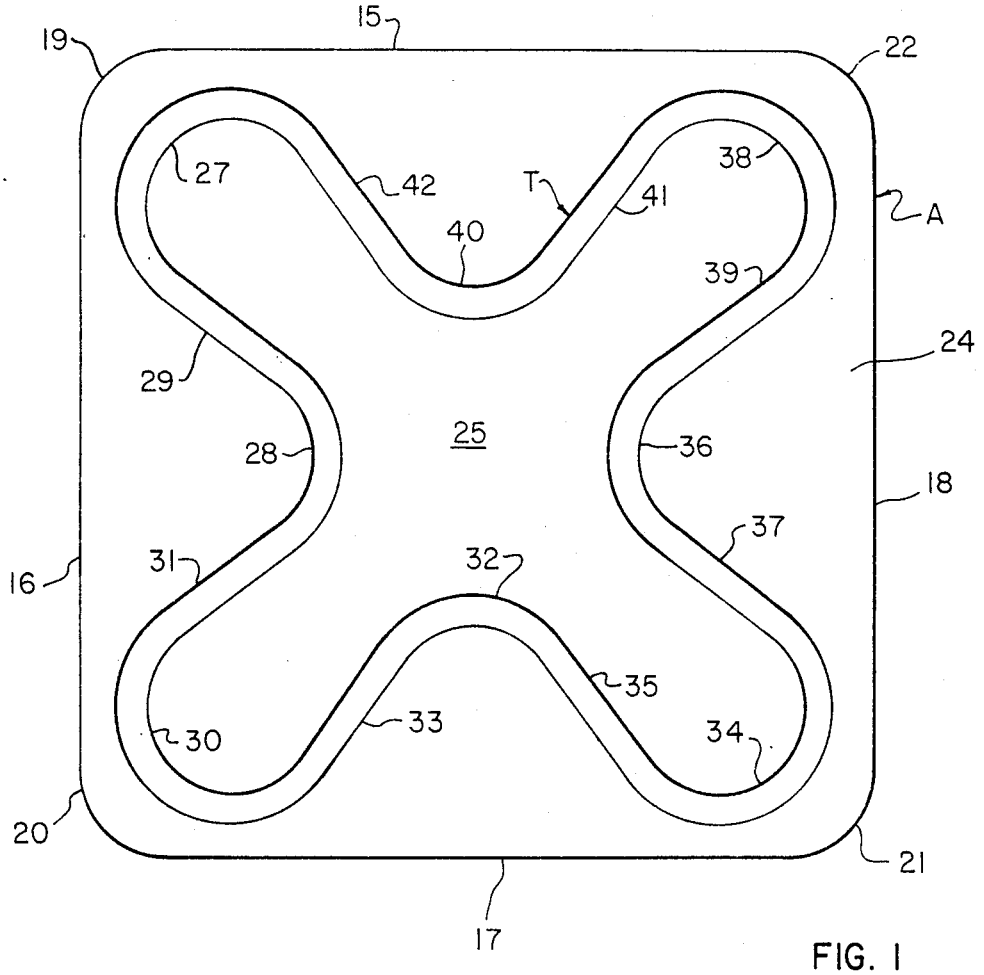
FIG. 1 is a top plan view of a track assembly of the device.
Figure 2:
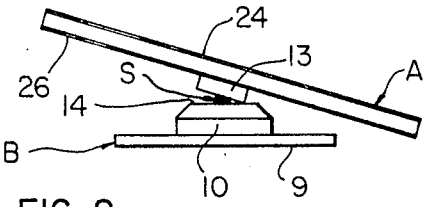
FIG. 2 is a side elevation, on a reduced scale, of the track assembly being tipped.
Figure 3:
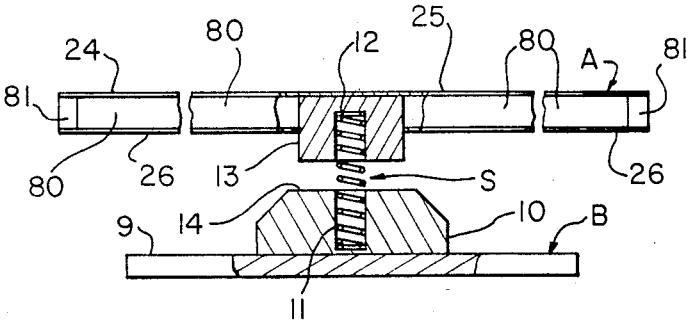
FIG. 3 is a condensed side elevation of the track assembly, with the central portion broken away to show the interior construction.

A pivoted slot track and car amusement device or game, constructed in accordance with this invention, includes a track assembly A of FIGS. 1–3 which provides a slot track T. In the form shown, the track T has a generally four-leaf clover configuration, although it will be understood that numerous other configurations may be utilized. The car C of FIG. 4 and FIGS. 10–14 is adapted to move around the track T when the track assembly A is tipped appropriately. The track assembly A, as in FIGS. 2 and 3, engages a relatively heavy coil spring S, which extends between the track assembly A and a base B, which is preferably placed on a level surface. The base B consists of a base plate 9 and a pedestal 10 having a socket 11 to receive the lower end of the coil spring S. The upper end of the coil spring S extends into a socket 12 of a block or abutment 13, which is cylindrical, or at least has a circular lower edge, and extends downwardly below the track assembly to engage top 14 of pedestal 10 when the assembly A is tipped, as in FIG. 2. When the track assembly A is tipped to different positions, as will be described later, the lower edge of block 13 will roll on the top 14 of pedestal 10 when shifted from one tipped position to another. The clearance between pedestal 10 and block 13 is exaggerated in FIG. 3, since it may be on the order of $\frac{1}{4}$ inch when the entire weight of the track assembly is on the spring. Coil spring S thus supports the weight of the track assembly, when in the horizontal position, although only a portion of the weight when the track is tipped, but spring S does maintain the track assembly centered when tipped to different positions, with respect to pedestal 10. The pedestal 10 may be reduced in cross section near the top, as shown, and may be rectangular, as shown, or have other shapes but with its top 14 larger than block 13.

The track assembly A, as in FIG. 1, is rectangular in shape, having four sides, i.e. sides 15, 16, 17 and 18, with rounded corners 19, 20, 21 and 22. The track T is formed between the interior configuration of a top outer panel 24 and the exterior configuration of a top inner panel 25, with the sides of the track T being parallel. In addition to the outer upper panel 24 and the inner upper panel 25, the track assembly includes a lower panel 26, through which block 14 extends, while a series of supports, to be described later, extend between the lower panel and the upper panels.

Progressing in a clockwise direction, track T may include an outer curve 27 adjacent corner 19 and an inner curve 28 opposite side 16, with a connecting portion 29 leading from outer curve 27 to inner curve 28. Outer curve 27 may be an arc of 180° or more, with a slight inward flare at each end, while inner curve 28 may be an arc of 90° or less with an outward flare at each end and portion 29 blending the two together, as along a generally straight line. The track T further includes an outer curve 30 adjacent corner 20, with a connecting portion 31 leading from inner curve 28 to outer curve 30. An inner curver 32 is opposite side 17, while a connecting portion 33 leads from outer curve 30 to inner curve 32. Similarly, an outer curve 34 is adjacent corner 21 with a connecting portion 35 leading from inner curve 32 to outer curve 34, and an inner curve 36 is opposite side 18 and a connecting portion 37 leads from outer curve 34 to inner curve 36. Track T further includes an outer curve 38 adjacent corner 22 while a connecting portion 39 leads from inner curve 36 to outer curve 38. An inner curve 40 is opposite side 15 and a connecting portion 41 leads from outer curve 38 to inner curve 40. Finally, a connecting portion 42 leads from inner curve 40 to outer curve 27, to complete the track. As will be evident, when the car C is moving around an outer curve, 27, 30, 34, or 38, it will be thrown outwardly by centrifugal force against the outer edge of the track T, but when passing around an inner curve 28, 32, 36 or 40, centrigual force will impel the car against the inner edge of the track. The solution to the problem produced by this change in forces acting laterally on the car will be discussed later.

Figure 4:
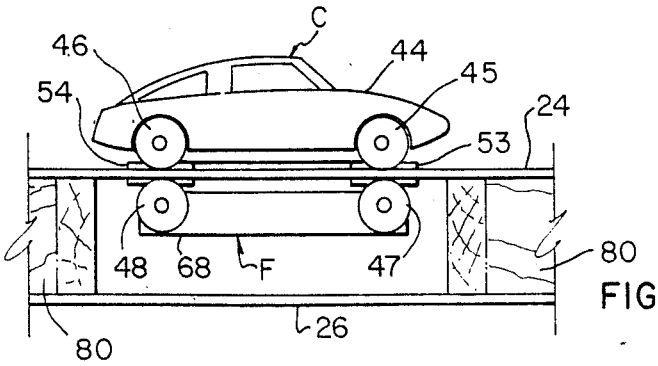
FIG. 4 is a fragmentary corner elevation on an enlarged scale, showing a car mounted on a special frame for engaging the track, a corner of the track assembly being removed for the purpose of showing the parts of the car frame beneath upper panels.

The car C, as in FIG. 4, may include a body 44 of any appropriately shaped toy car from which the wheels have been removed. The body 44 need not be a toy racing car, since any other object which can be associated with speed may be utilized, such as a motorcycle with or without a rider, a race horse, a racing greyhound, or for certain countries, an ostrich or a camel. This body is mounted on a frame F having a pair of outer wheels 45 and 46, which engage the top of the top outer panel 24 and a pair of lower outer wheels 47 and 48, which engage the bottom of the top outer panel 24, each as the car moves around the track. An upper inner wheel 49 of FIG. 6 and a corresponding upper wheel behind wheel 49 in FIG. 6 engage the top of inner panel 25, while a pair of lower inner wheels 50 and 51 of FIGS. 6 and 7 engage the bottom of inner panel 25, each as the car moves around the track. The wheels just referred to permit the car to roll around the track with a minimum of friction and prevent the car from leaving the track in an upward or downward direction. Thus, the wheels just described may be conventional wheels, but preferably are equipped with ball bearings or other type of low friction bearings.

Figure 5:
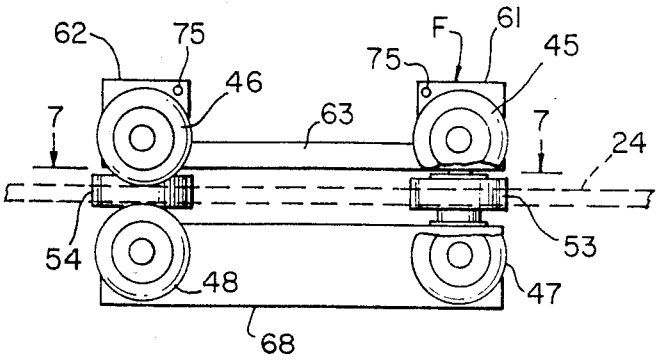
FIG. 5 is a side elevation of the car frame, on a further enlarged scale, the position of an upper panel being indicated by dash lines.
Figure 6:
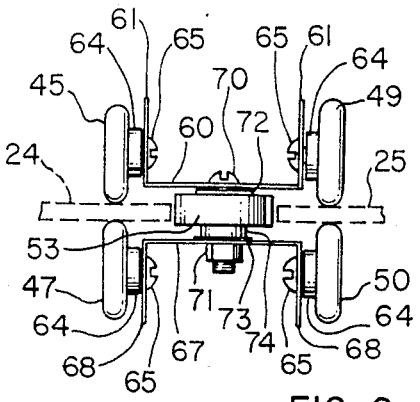
FIG. 6 is an end elevation of the frame for the car, the position of the upper panels between which the track is formed being indicated by dash lines.
Figure 7:
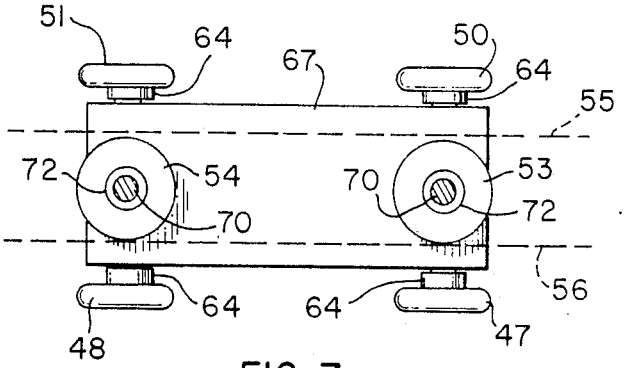
FIG. 7 is a horizontal section taken along line 7—7 of FIG. 5, the position of the edges of the track being indicated by dash lines.
Figure 8:
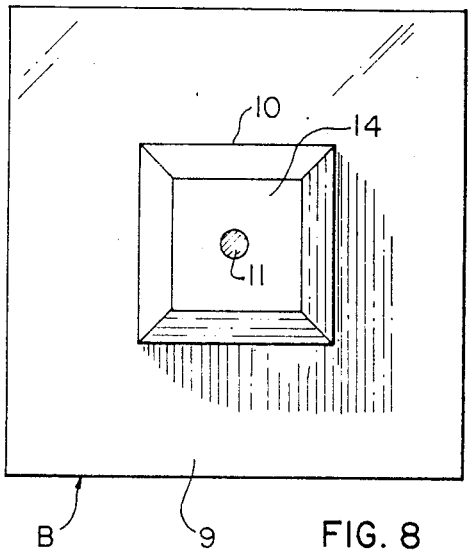
FIG. 8 is a top plan of the base of the track assembly.
Figure 10:
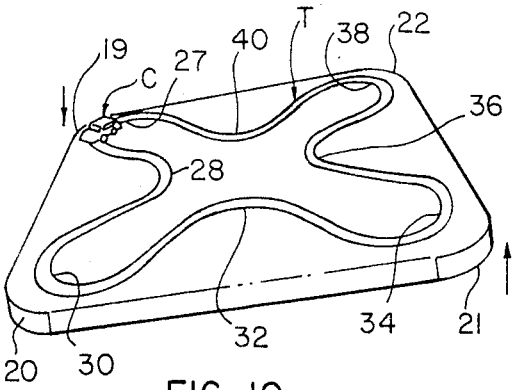
FIG. 10 is a perspective view of the track assembly only, showing a tipped position of the track assembly for propelling the car around a portion of the track to the position shown.

In addition to the wheels or bearings which engage the top and bottom of the panels at each side of the track, the car C is guided around the track by a pair of ball bearings 53 and 54, mounted between the upper and lower halves of the frame to which the car body 44 is attached, as shown in FIGS. 5, 6 and 7, between the inner and outer edges 55 and 56 of the track, indicated in FIG. 7, by dot-dash lines.

These bearings 53 and 54, as in FIG. 7, are disposed within the track at all times, being maintained there by the wheels engaging the panels. Ball bearings 53 and 54 are longitudinally spaced apart, being at positions corresponding to the front and rear wheels, although other positions may be found suitable. The width of the track is slightly greater than the diameter of the guide bearings, in order to permit the ball bearings to thrust against the outer edge of the track without touching the inner edge, as well as to thrust against the inner edge of the track without touching the outer edge. The clearnace between the ball bearings and the track may be on the order of $\frac{1}{8}$ in., so as to insure the foregoing condition but minimize the impact against the side of the track when the car shifts from an outer curve to an inner curve and vice versa, although the connecting portions of the track reduce the impact. They also permit a greater gain in acceleration when the track is tipped so that acceleration of gravity will act in the direction of the connecting portion; that is, the connecting portion slants downwardly at the greatest angle permitted by the surface on which the base B rests. The ball bearings 53 and 54 may be conventional in nature and their diameter, as well as the width of the track, should be correlated with the radius of the inside and outside curves, so that there will not be binding of the guide bearings as they pass around the curves, which would tend to reduce the speed of the car C or the like.

As in FIG. 5, an upper portion of the frame F includes a plate 60 having a pair of higher, upstanding flanges 61 at each end of one side and a similar pair of higher upstanding flanges 62 at each end of the opposite side, with an upright, lower reinforcing flange 63 connecting the flanges 61 and 62 at each side. The wheels 45 and 46 on one side and the wheel 49 and the wheel behind it in FIG. 6, on the opposite side, are mounted on the flanges 61 and 62. Thus, each wheel may be provided with an inner hub 64 and connected by a screw or bolt 56 to the frame, the screw or bolt 65 passing through the respective flange 61 or 62 and attaching the hub 65 securely to the flange. It will be noted that the flange 63, which connects the mounting flanges 61 and 62 on each side, is lower than the mounting flanges in order to accommodate the car body 44.

A lower plate 67 has a downwardly extending flange 68 at each side, which need not be cut away to provide a flange corresponding to the connecting flange 63 on the upper plate 60. The lower wheels 47 and 48, on one side, and 50 and 51, on the opposite side, as in FIG. 7, are attached to the flanges 68 by a screw or bolt 65, which extends through the corresponding flange and also into hub 64, which may be a portion of a central race of a bearing, when utilized as a wheel.

The guide bearings 53 and 54 are secured between the upper and lower plates of the frame in a suitable manner, as by bolts 70, whose heads engage upper plate 60 and a nut 71 for the bolt engages plate 67, as in FIG. 6. A washer 72 spaces the central race of a ball bearing from upper plate 60, while a similar washer 73 may engage lower plate 67, with an arbor or spacer 74 interposed between the washer and the central race. The car body 44 may be attached to frame F by small bolts installed in holes 75 of flanges 61 and 62 of FIG. 5.

Although other sizes and dimensions may be utilized, a successfully operated amusement device or game of this invention includes parts with dimensions and origins as follows. Track assembly A is a 36 inch square with rounded corners and base plate 9 is a 24 inch square, while the radius of the outer and inner curves, such as curves 27 and 28, is 9 inches. The width of track T is one inch, while the guide bearings 53 and 54 are 7/8 inch in diameter, leaving a clearance of $\frac{1}{8}$ inch. These guide bearings are sold under the trademark (FAFNIR S3KB) while the wheels mounted on the car frame F are ball bearing, shower door rollers of SLIDE-CO of Montclair, Calif. The sockets 11 and 12 for the coil spring S are each $1\frac{3}{8}$ inch in diameter, while the coil spring itself is also $\frac{3}{8}$ inch in diameter to produce a sure fit and has an uncompressed length of 5 inches.

Figure 9:
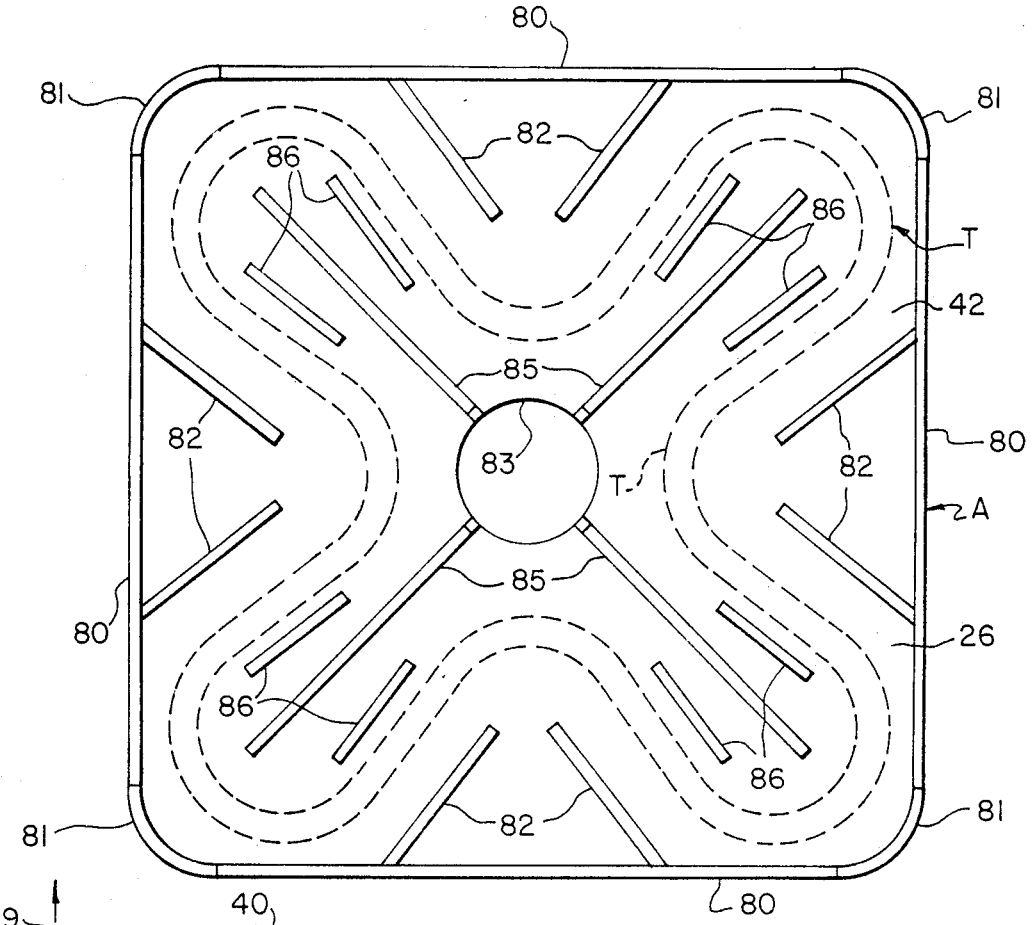
FIG. 9 is a top plan view of a base panel of the track assembly, showing various ribs and outer bars supporting the panels between which the track is formed, the position of the track between the panels above being shown by dash lines.

The track assembly A further includes, as illustrated in FIG. 9, edge strips and ribs connecting the lower panel 26 with the upper panels 24 and 25, not only to support the upper panels but also to rigidify the structure as a whole. These supporting and rigidifying elements, as in FIG. 9, include side strips 80, which extend between the outer edges of the sides of lower panel 46 and outer upper panel 24. The curved corners may be provided with correspondingly shaped, arcuate strips 81, one or more of which may be removable, in order to install or remove the car and its frame from the track T. In FIG. 4, the side view is taken with one of the corner strips 81 removed. Thus, the undercarriage of the car assembly can be seen, as well as the portion of the guide ball bearings 53 and 54 which project above and below the panels between which the track is formed. The outline of Track T which, of course, is between the inner and outer upper panels, is shown in dotted lines in FIG. 9, in order to correlate the shape of the track with the various supporting members. Those members supporting outer panel 24 include outer ribs 82, which extend angularly and inwardly from side strips 80, in general parallel relation to the connecting portions 29, 31, 33, 35, 37, 39, 41 and 43 of the track, which are indicated in FIG. 1. The upper inner panel 25 is supported at the center by block 14 of FIGS. 2 and 3, which extends upwardly through a hole 83 in the lower panel 26. Panel 25 is further supported by longer ribs 85 which extend outwardly from hole 83 toward each of the corners of the assembly and nearly to the track T at the outer curves 27, 30, 34 and 38 of FIG. 1, as well as shorter ribs 86 positioned near the connecting portions of the track, as listed above. Each of the straight side wall strips 80 may be attached, as in fixed relation, both to the lower panel 26 and the upper, outer panel 24, as well as the ribs 82.

The block 14 may also be rigidly affixed to the inner upper panel 25 so as to support the track assembly solidly when engaging top 14 of pedestal 10 and from the upper end of the coil spring when the track assembly is horizontal. Both longer ribs 84 and shorter ribs 86 may be rigidly affixed to both lower panel 26 and upper inner panel 25. As indicated previously, one or more of the arcuate corner strips 81 may be removably affixed between panels 24 and 26 while the remainder may be permanently affixed. Due to the reinforcement provided by the ribs and strips described, the entire track assembly is rigid and will withstand the rigors of use.

As will be evident, coil spring S supports the track assembly A in a manner such that any side or any corner may be tipped downwardly or upwardly, as desired. Various positions of the track assembly, for causing the car C to accelerate from one position to another, due to gravity, are illustrated in FIGS. 10–14.

Figure 11:
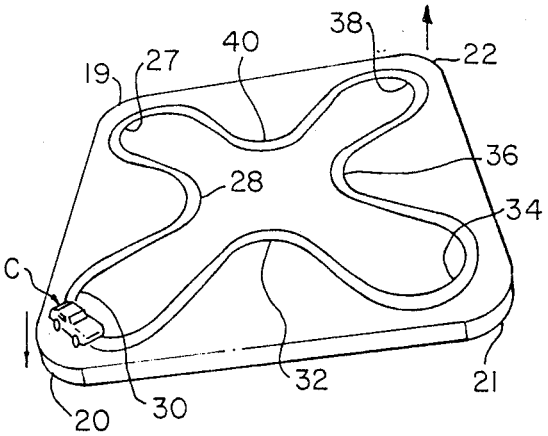
FIG. 11 is a perspective view similar to FIG. 10, but showing a tipped position of the track assembly for propelling the car around the track to another position shown.
Figure 12:
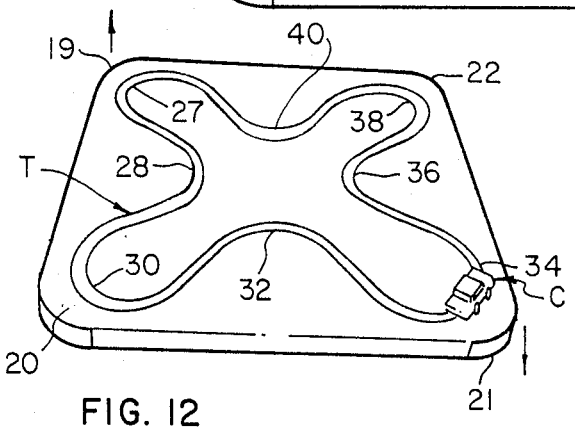
FIG. 12 is a perspective view, similar to FIGS. 10 and 11, showing a tipped position of the track assembly for propelling the car to a further position shown.
Figure 13:
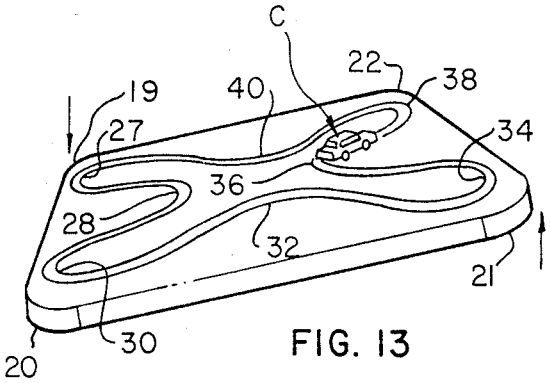
FIG. 13 is a perspective view of still another tipped position of the track assembly for propelling the car to a still further position shown.

In order to play the game, a contestant grasps the track assembly, as with both hands at two of the corners, such as corners 19 and 22. The positions of the track assembly of FIGS. 10–14 are illustrated as though the track assembly were grasped by the contestant at these positions, with downward arrows indicating the lowest corner of the track assembly and upward arrows the uppermost corners for producing movement of the car C to the position in which it is shown. Thus, in FIG. 10, the corner 19 has been shifted downwardly and the corner 21 upwardly, as indicated by the arrows, to cause the car C to move from the inner curve 40 to the outer curve 27, the car being shown at the approximate center of the outer curve 27, the car being shown at the approximate center of the outer curve 27, as it moves around it. Illustrated in FIG. 11 is movement of the car, by gravity, from the inner curve 28 to the next outer curve 30. For this purpose, the corner 22 is raised and the corner 20 is lowered, as indicated by the arrows. With the car on inner curve 32, the corner 21 is lowered and the corner 19 raised, as shown in FIG. 12, by the arrows, so that the car will move by gravity to the outer curve 34. As the car rounds curve 34, the corner 21 is raised and the corner 19 lowered, as shown in FIG. 13, by the arrows, so that the car will move to the inner curve 36. As the car rounds inner curve 36, the track assembly is again tipped so that the corner 22 will be lowered and the corner 20 raised, as shown by the arrows in FIG. 14, so that the car will travel from the inner curve 36 to the outer curve 38.

The tilted positions of the track illustrated in FIGS. 10–14 are only representative of the tilted positions which may be used, in succession, to cause the car to move completely around the track, as in a clockwise direction. The speed of the car can be increased each time the track is tilted in proper direction, provided that the contestant has the coordination to tilt the track to a different position as the car rounds a particular curve, so that the next tilt will increase the speed already attained by the car. As will be evident, the outer race of each center ball bearing 53 and 54 will be started rolling when the car first engages a curve and will also increase its speed as additional track edges are engaged. It is noted that, when progressing in one direction around the track, the center bearings will be rotated in the same direction, irrespective of which edge of the track is engaged. Thus, the cumulative rotation of the center ball bearings will reduce the amount of friction which might otherwise be produced. Similarly, the wheels which engage the track will tend to keep rotating and increase in speed of rotation as each acceleration is produced.

As will be evident from the previous description of the tilting illustrated in FIGS. 10–14, the corners of the track assembly which should be raised and lowered are those with which the connecting portion between two curves are most nearly aligned. Thus, in order to move the car around the track in a clockwise direction, assuming that the car is started from outer curve 27, at corner 19, corner 21 will be lowered and corner 19 raised, i.e. the reverse of the position shown in FIG. 10, in order to cause the car to move to inner curve 28. The movement from inner curve 28 to outer curve 30 has been described in connection with FIG. 11. As the car C is moving around the outer curve 30, the corner 20 is lifted and the corner 22 lowered by the contestant, causing the car to move by gravity to the inner curve 32. Movement of the car from inner curve 32 to outer curve 34, from the latter to inner curve 36 and from the latter to outer curve 38 have been described in connection with FIGS. 12, 13 and 14, respectively, it being noted that the changes in tilting in order to secure maximum acceleration of the car, should be made by the contestant as the car is moving around the curve to which it has been moved by the previous tilt.

Figure 14:
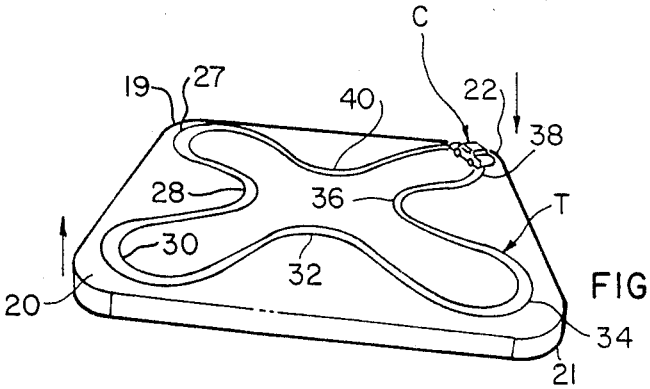
FIG. 14 is a perspective view of still another tipped position of the track assembly for propelling the car to the still further position shown.

As the car rounds inner curve 38, the track is tilted so that corner 22 is raised and corner 20 lowered, i.e. the reverse of the position of FIG. 14, so that the car will move to inner curve 40. Movement of the car from inner curve 40 to corner 27 has been described in connection with FIG. 10. Movement of the car around the track may be continued by repeating the series of movements of the track just described. As will be evident, movement of the car in the opposite direction around the track, i.e. in a counter-clockwise direction, may be accomplished by reversing the tilts described for clockwise movement, as the car rounds each curve in turn.

It will be noted that, to cause the car to move from one outer curve to another outer curve, a shift of the track assembly twice is required. Of course, as the car shifts from one curve to the next, it normally retains a major portion of the speed it acquired, due to the influence of gravity in moving between an inner and an outer curve or vice-versa, so that as the shift in position of the track assembly is made as the car is rounding the curve to which it has been directed, the car will tend to accelerate to a faster speed as it moves from one curve to another. Thus, the time required to cause the car to make a complete circuit of the track can be lessened considerably by keeping the car moving and accelerating at all times. The dexterity and coordination of the contestant are the most important factors in increasing the speed of the car in moving around the track.

The game can be played on the basis of the amount of time required for a contestant to move the car from a starting position on the track for a specified number of circumnavigations of the track, or the total number of movements around the track produced by the contestant during a specified time period. The track and car may also be utilized merely for personal enjoyment, since a person will normally enjoy making a car move around the track at a relatively fast speed, even when the person is not competing with one or more other persons.

As indicated previously, a toy motorcycle, with or without a rider, railroad engine or car, horse, greyhound ostrich or any other object which could be expected to move in a manner considered to be relatively fast, or even slow, such as a turtle, could be used instead of the racing car.

Although a preferred embodiment of this invention has been illustrated and described, it will be understood that other embodiments may exist and that various changes may be made, all without departing from the spirit and scope of this invention.

What is claimed is:

1. An amusement device or game including a track and an object to be moved around said track comprising the combination of:

a track assembly having means providing a continuous track slot having spaced parallel edges, said track slot having a plurality of curves facing in different directions and connecting portions extending between said curves;

wheeled means supporting said object for movement around said track, said wheeled means engaging a portion of said track assembly on opposite sides of the edges of said track slot both above and below said track;

means within said track slot and engageable with either edge of said slot for causing said wheeled means to follow said track;

means for supporting said track assembly for manual pivotal movement to different downward inclinations corresponding to the direction of substantially each of said connecting portions and each of said curves for causing said wheeled means to move by gravity around said curves and from one curve to another along said connecting portions and to tend to increase in speed while moving along each said curve and connecting portion;

said means for supporting said track assembly including resilient means for supporting at least a portion of the weight of said track assembly;

a base for receiving said resilient means and extending around and laterally beyond said resilient means; and abutment means depending from said track assembly, surrounding said resilient means and engageable with said base for supporting essentially the remainder of the weight of said track assembly to permit pivotal movement thereof in any direction of essentially the 360° periphery thereof.

2. An amusement device or game combination as defined in claim 1, wherein:

said track assembly includes an inner panel having an outer contour providing the inner edge of said track slot; and an outer panel having an inner contour providing the outer edge of said track slot.

3. An amusement device or game combination as defined in claim 2, wherein:

said wheeled means includes two longitudinally spaced pairs of wheels engaging the top and bottom, respectively, of said outer panel adjacent said track slot;

two longitudinally spaced pairs of wheels engaging the top and bottom, respectively, of said inner panel adjacent said track slot; and said pairs of wheels engaging said outer panel being opposite said pairs of wheels engaging said inner panel.

4. An amusement device or game combination as defined in claim 3, including:

a longitudinally spaced pair of relatively freely rotatable, circular members having an axis of rotation perpendicular to the axis of rotation of said wheels and disposed between the edges of said track slot, for guiding said wheeled means around said track slot; and means for supporting the lower wheels in engagement with the bottom of said inner and outer panels, including means extending through said circular members for positioning said circular members between the edges of said track slot.

5. An amusement device or game combination as defined in claim 4, wherein:

said relatively freely rotatable, circular members disposed between the edges of said track slot are disposed at approximately the same longitudinal positions as said pairs of wheels.

6. An amusement device or game combination as defined in claim 1, wherein:

a plurality of said connecting portions of said track slot extend in an approximately straight line.

7. An amusement device or game combination as defined in claim 1, wherein:

two or more of said curves have a center of radius on the inside of said track; and two or more of said curves have a center of radius on the outside of said track.

8. An amusement device or game combination as defined in claim 7, wherein:

said track assembly is generally rectangular;

said curves having an inside center are disposed adjacent a corner of said track assembly; and said curves having an outside center are disposed opposite a side of said track assembly.

9. An amusement device or game combination as defined in claim 1, including:

a pair of spaced, relatively freely rotatable circular members disposed between the edges of said track slot for guiding said wheeled means around said track.

10. An amusement device or game including a track and an object to be moved around said track, comprising:

a track assembly having means providing a continuous track slot, having spaced, parallel edges, said track having a plurality of adjacent curves facing in different directions and connecting portions extending between said curves;

wheeled means supporting said object for movement around said track, said wheeled means engaging a portion of said track assembly on opposite sides of the edges of said track both above and below said track;

means engaging said track edges for causing said wheeled means to follow said track;

a base having a pedestal provided with an upright socket and a flat top;

a coil spring whose lower end extends into said pedestal socket; and a block having a circular lower end mounted centrally of the underside of said track assembly and having an upwardly extending socket receiving the upper end of said coil spring, said pedestal and block being relatively closely spaced, whereby said track assembly may be tipped in any direction while supported by said lower end of said block engaging said top of said pedestal.

11. An amusement device or game as defined in claim 10, including:

an upper inner panel having an outer contour providing the inner edge of said track;

an upper outer panel having an inner contour providing the outer edge of said track;

a lower panel below said inner and outer panels having an outer periphery corresponding to said upper panel;

said block extending through said lower panel to the underside of said upper inner panel;

a series of strips extending between and connecting at least a major portion of the outer periphery of said lower panel and said outer upper panel;

a series of ribs extending between and connecting said lower panel and said upper inner panel but inside said track; and a series of ribs extending between and connecting said lower panel and said upper outer panel but outside said track.

12. An amusement device or game including a track and an object to be moved around said track by gravity, comprising the combination of:

a track assembly providing a continuous track slot having sinuous convolutions and spaced, parallel edges, said convolutions including curves facing both inwardly and outwardly from the center of said track assembly;

means for supporting an object for movement around said track slot by gravity including a pair of longitudinally spaced, rotatable members maintained between the edges of said track slot and engageable with either edge;

means for supporting said track assembly for manual tilting downwardly in essentially any direction of the 360° periphery thereof;

said means for supporting said track assembly including a coil spring extending upwardly and centrally to said track assembly for supporting at least a portion of the weight thereof;

a base for receiving said coil spring and extending around and laterally beyond said coil spring; and abutment means depending from said track assembly, surrounding said coil spring and engageable with said base for supporting at least the remainder of the weight of said track assembly for movement of said track assembly to downward inclinations of any desired part of the 360° periphery thereof.

13. An amusement device or game combination as defined in claim 12, including:

a first series of curves spaced approximately 90 degrees apart and having a general radius of curvature on the inside of said track slot; and a second series of curves spaced approximately 90 degree apart and having a general radius of curvature on the outside of said track slot.

14. An amusement device or game combination as defined in claim 13, wherein:

said curves of said first series alternate with said curves of said second series and are connected by generally straight line portions of said track slot.

15. An amusement device or game including a track and an object to be moved around said track by gravity, comprising:

a generally square track assembly providing a continuous track having spaced parallel edges;

said track having a series of outer curves adjacent the corners of said track assembly, said outer curves being convex with respect to the center of said track assembly;

said track having a series of inner curves opposite the sides of said track assembly and each concave with respect to the center of said track assembly;

said track having a series of connecting portions extending between the respective outer curves and inner curves;

means for supporting an object for movement around said track;

means for supporting said track assembly, whereby said track assembly may be tipped to different positions to cause said object to move by gravity around said track, said means for supporting said track assembly including a pedestal having a flat top and a central upright socket;

a cylindrical block mounted centrally of said track assembly and extending downwardly therefrom, said block having a central upright socket;

a coil spring having one end in said socket of said pedestal and the other end in said socket of said block; and said coil spring supporting said track assembly when untipped but the lower edge of said block engaging the top of said pedestal when said track is tipped.

16. An amusement device or game as defined in claim 15, wherein:

said connecting portions of said track are generally straight.

17. An amusement device or game as defined in claim 15, wherein:

said means for supporting said object for movement includes a pair of longitudinally spaced, circular members disposed between the edges of said track and each rotatable about an axis perpendicular to the plane of said edges.

* * * * *